United States Patent [19]

Orr

[11] Patent Number: 5,014,364

[45] Date of Patent: May 14, 1991

[54] GARMENT CROTCH STRUCTURE AND METHOD

[76] Inventor: Donna R. Orr, 11609 Barchetta Dr., Austin, Tex. 78758-3757

[21] Appl. No.: 455,306

[22] Filed: Dec. 22, 1989

[51] Int. Cl.[5] ..... A41B 11/00

[52] U.S. Cl. ..... 2/408; 2/409

[58] Field of Search ..... 2/79, 72, 73, 67, 227, 2/408, 409; 450/105

[56] References Cited

U.S. PATENT DOCUMENTS

| | | | |
|---|---|---|---|
| D. 191,908 | 12/1961 | Goldstein | 450/105 X |
| 620,317 | 2/1899 | Hatch . | |
| 701,744 | 6/1902 | Love | 2/408 |
| 1,470,356 | 10/1923 | Graham | 2/79 X |
| 2,062,596 | 12/1936 | Monelte | 2/408 X |
| 2,476,585 | 7/1949 | Cohen | 2/408 X |
| 2,522,008 | 9/1950 | Wohlman | 450/105 |
| 2,522,009 | 9/1950 | Wohlman | 450/105 |
| 2,703,404 | 3/1955 | Lawson | 2/227 |
| 3,094,126 | 6/1963 | Goldstein | 450/105 |
| 3,208,455 | 9/1965 | Fridolph | 450/105 |
| 3,224,448 | 12/1965 | Diebold | 450/105 |
| 3,362,029 | 1/1968 | Comerma | 2/227 X |
| 3,398,739 | 8/1968 | Marino | 450/105 |
| 3,487,473 | 1/1970 | Janhsen | 2/240 |
| 3,547,128 | 12/1970 | Keltner | 2/240 |
| 3,823,419 | 7/1974 | Breitbart | 2/227 |
| 3,877,078 | 4/1975 | Tepper | 2/90 X |
| 3,953,895 | 5/1976 | Lowth | 2/409 X |
| 4,019,208 | 4/1977 | Walser, Jr. | 2/409 X |
| 4,101,982 | 7/1978 | Muller | 2/408 X |
| 4,106,514 | 8/1978 | Lowth | 2/409 X |

FOREIGN PATENT DOCUMENTS

| | | | |
|---|---|---|---|
| 855082 | 9/1952 | Fed. Rep. of Germany | 2/409 |
| 1925302 | 6/1971 | Fed. Rep. of Germany | 2/409 |
| 2038063 | 12/1971 | Fed. Rep. of Germany | 2/409 |
| 2134219 | 1/1973 | Fed. Rep. of Germany | 2/409 |
| 1204184 | 1/1960 | France | 2/79 |
| 1218528 | 5/1966 | France | 2/79 |

*Primary Examiner*—Werner H. Schroeder
*Assistant Examiner*—Jeanette E. Chapman
*Attorney, Agent, or Firm*—J. Nevin Shaffer, Jr.; Russell D. Culbertson

[57] ABSTRACT

A garment crotch structure is adapted to be incorporated into several types of women's garments for providing an opening which may be used to perform bodily functions without removing the garment. The garment crotch structure includes generally separate right and left garment pieces. Each garment piece includes a leg opening for that particular side of the garment, a garment crotch portion adjacent to the leg opening, and a connecting section extending upwardly both front and rear from the particular garment crotch portion to both sides of the garment at the garment waist area. The garment pieces are connected together only at the waist area of the garment generally with the two crotch portions overlapping and with each garment piece having a free edge extending from the particular crotch portion to the waist area at the opposite side of the garment. These free edges may be parted manually by the wearer preferably from the rear of the garment to form the desired crotch opening. However, the connection of the edges at opposite sides of the garment retain the crotch portions overlapped in normal use.

9 Claims, 2 Drawing Sheets

GARMENT CROTCH STRUCTURE AND METHOD

BACKGROUND OF THE INVENTION

The invention relates to garments, and particularly to a garment crotch structure for women's garments with an opening that is adapted to remain closed in normal use but may be conveniently opened for performing bodily functions. The garment crotch structure may be incorporated into women's underwear and also into certain types of women's outerwear including bathing suits and leotards.

Many types of women's garments, including briefs, pantyhose, swimsuits, and other types of active wear, include a crotch portion. Due to the crotch portion in these types of garments, the garment must be pulled down to enable the wearer to perform bodily functions. Some outerwear garments such as one-piece bathing suits and leotards pose a particular problem in that substantially the entire garment must be removed in order for the wearer to perform bodily functions.

The problem of having to remove an undergarment having a tight fitting crotch portion to enable the wearer to perform bodily functions has been recognized for many years. U.S. Pat. Nos. 2,522,008 and U.S. Pat. No. 2,522,009 to WOHLMAN were directed to women's foundation garments having an openable crotch structure. The crotch structure shown in the WOHLMAN patents had a separate crotch section that included two overlapping panels positioned just in the crotch area of the garment. The panels could be separated just in the crotch area for providing an opening purportedly for allowing bodily functions to be performed without removing the garment.

U.S. Pat. No. 4,301,550 to CARVER was directed to an openable crotch structure specifically for pantyhose. The pantyhose crotch structure taught by CARVER included a crotch portion made of a double knit fabric material. The overlapping material included slits extending just in the crotch area that were adapted to be parted by digital manipulation to provide an opening just in the crotch of the garment through which urination could be accomplished without removal or partial removal of the garment.

There were several problems associated with these prior openable garment crotch structures. First, the various types of overlapping flaps of material had to be manually held open to enable the wearer to perform the desired bodily function. Also, the prior crotch structures were unable to provide sufficient separation for enabling the wearer to conveniently urinate or defecate. Furthermore, due to their structural requirements, the prior openable crotch structures were suitable only for use in undergarments.

It is therefore a general object of the invention to provide a garment crotch structure adapted to overcome the above described problems and others associated with garment crotch structures for enabling the wearer to perform bodily functions without removing or partially removing the garment.

SUMMARY OF THE INVENTION

The invention is directed to a garment crotch structure that may be incorporated into many different types of women's garments, and generally any garment that includes a crotch portion. For example, the garment crotch structure of the invention may be incorporated into pantyhose, other underwear, aerobics and dance leotards, cycling and other exercise pants or shorts, one-piece swimsuits, and the bottom portion of two-piece swimsuits.

The garment crotch structure according to the invention includes a right garment piece and a left garment piece. The right and left garment pieces include respectively a first and second overlapping crotch portion and are connected so that the crotch portions are openable to enable the wearer to conveniently perform bodily functions without removing the garment. Further, the crotch structure once opened is adapted to remain open without having to be held in the open position by the wearer. Also, the right and left garment pieces are connected so that the first and second overlapping garment crotch portions remain closed in normal use and even during rigorous exercise.

The right garment piece includes at its lowermost edge, a right leg opening and a bottom section of the first overlapping crotch portion, the first crotch portion being adapted to form a crotch of the garment. The right garment piece also includes first crotch portion retaining means connected between the first crotch portion and the left garment piece for maintaining the first crotch portion in the desired position as the garment is worn, but allowing the first crotch portion to be moved out of the garment crotch area without removing the garment.

Similarly to the right garment piece, the left garment piece includes a lowermost edge defined by a left leg opening and a bottom section of the second overlapping crotch portion, the second crotch portion being adapted to form a second crotch of the garment overlapping the first crotch portion. The left garment piece further includes second crotch portion retaining means connected between the second crotch portion and the right garment piece for maintaining the second crotch portion in position in the crotch of the garment in normal use but enabling the second crotch portion to be moved out of said position manually without removing the garment.

Preferably, the first crotch portion retaining means includes a first connecting section of material extending from the first crotch portion upwardly both front and rear to the waist portion of the garment at both the left and right sides thereof. A left edge of the first connecting section extends from the first crotch portion upwardly front and rear to the left side of the garment at the waist area. Similarly, the second crotch portion retaining means includes a second connecting section of material extending from the second crotch portion both front and rear to the waist portion at both the left and right sides of the garment. A right edge of the second connecting section extends from the second crotch portion front and rear to the far right side of the garment at the waist area.

According to the invention, the right and left garment pieces are connected only by the two connecting sections in the waist area of the garment, with the sections forming overlapping panels in the front and rear of the garment. The left and right edges of the panels, and thus the first and second crotch portions, are free to be parted manually to enable the wearer to perform bodily functions without having to remove the garment. Further, once opened and the wearer is seated, contact with the seat prevents the two crotch portions from closing back together, and thus, continuous manipulation is not required. However, because the right and left garment pieces are connected in the waist area, with each crotch portion being held at opposite sides of the garment, the crotch opening remains closed in use even during strenuous physical activity.

Where the crotch structure of the invention is incorporated into pantyhose or exercise tights for example, the right and left leg openings are each connected to a leg portion of the garment. Preferably, such leg portions are integrally formed with each garment piece. Alternatively, where there are no leg portions to the particular garment, the leg openings may be cut high on the sides so as to correspond generally to the free edge of the opposite garment piece.

The invention also encompasses a method for maintaining an openable garment crotch comprised of two overlapping crotch portions closed in normal use. The method includes the step of connecting the first garment crotch portion between the right leg opening and the left side of the garment in the waist area so as to form a first free edge of material extending from the first crotch portion front and rear generally to the waist area. The method further includes the step of connecting the second crotch portion between the left leg opening and the right side of the garment in the waist area so as to retain the second crotch portion in the crotch area of the garment with a second free edge of material extending from the second crotch portion to the right side of the garment. These connections retain the first and second crotch portions in an overlapped position in the crotch of the garment in normal use, but allow the crotch portions to be separated by digital manipulation to form an opening which enables the wearer to perform bodily functions without having to remove the garment.

These and other objects, advantages, and features of the invention will be apparent from the following description of the preferred embodiments, considered along with the accompanying drawings.

DESCRIPTION OF THE PREFERRED EMBODIMENTS

Figure 1:
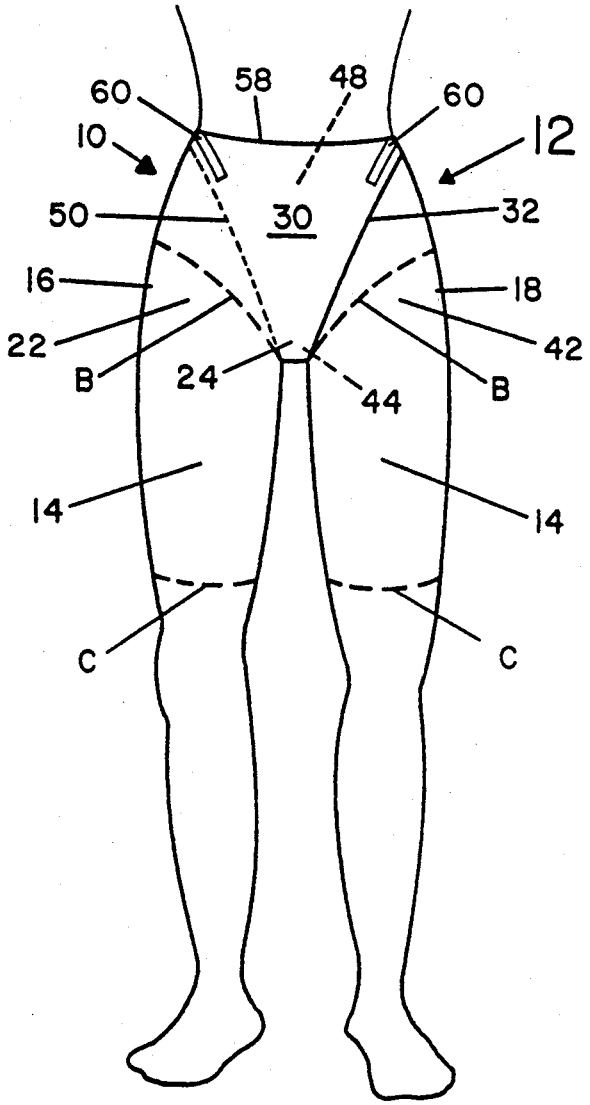
FIG. 1 is a view in perspective of a garment crotch structure embodying the principles of the invention incorporated into a pair of pantyhose.
Figure 2:
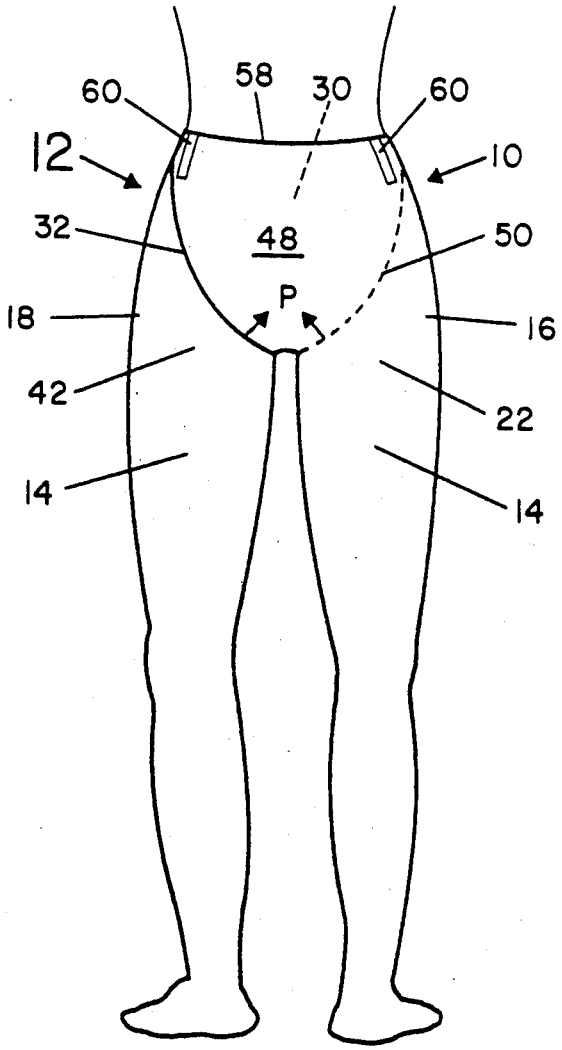
FIG. 2 is a view in rear perspective of the garment shown in FIG. 1.
Figure 3:
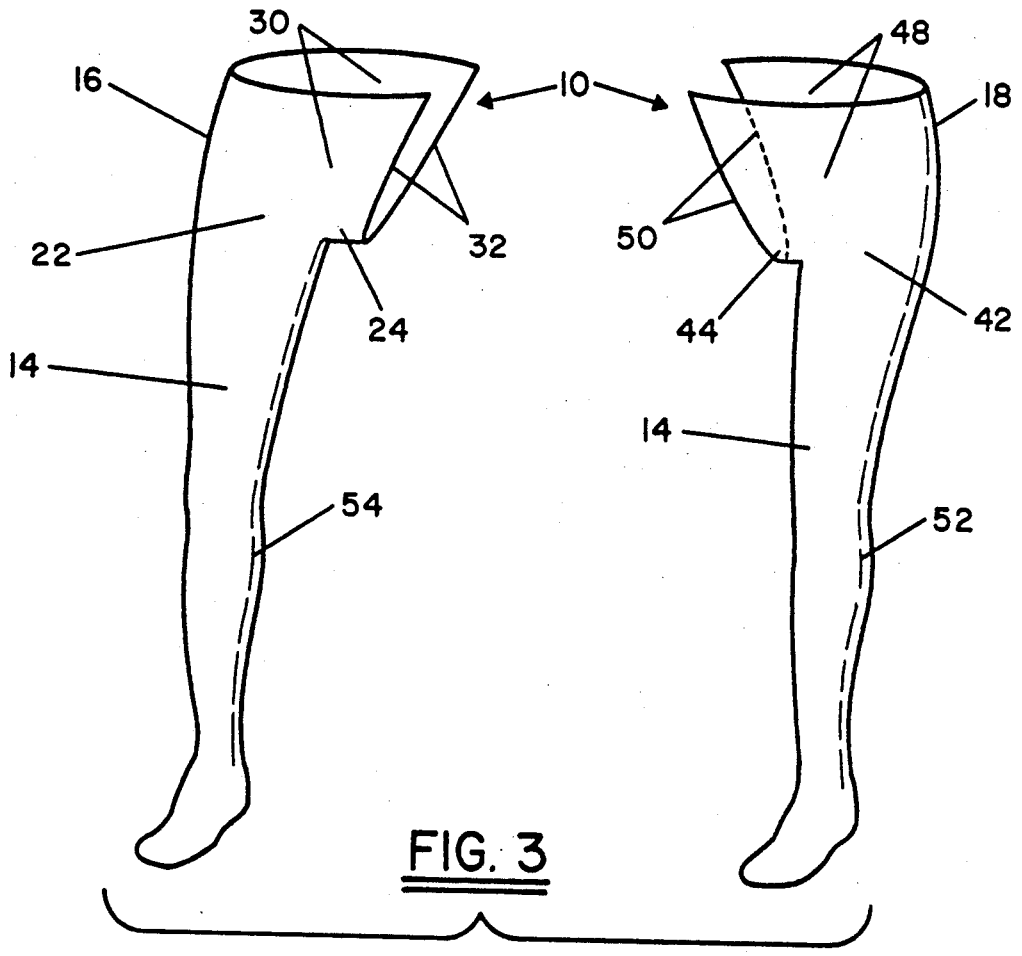
FIG. 3 is a view in perspective similar to FIG. 1, but separated into left and right garment pieces.

FIGS. 1–3 illustrate one preferred form of garment crotch structure 10 embodying the principles of the invention. The embodiment shown in FIGS. 1–3 is incorporated into a pair of pantyhose or exercise tights 12 having leg portions 14. However, it will readily be appreciated that the garment crotch structure 10 may be incorporated into a pair of women's briefs or a swimsuit bottom in which case, the garment has no leg portions and would terminate in the area of line "B" in FIG. 1, depending upon the desired style of garment. In other garments such as cycling shorts, leg portions are included but terminate at approximately line "C" shown in FIG. 1, slightly above the knee or at any other desired height.

As shown in FIGS. 1–3, the garment crotch structure 10 according to the invention includes a right garment piece 16 and a left garment piece 18. The right garment piece 16 includes a right leg opening generally indicated at reference number 22 and a first garment crotch portion 24. The right garment piece 16 also includes first retaining means, in this embodiment comprising a connecting section 30, extending from the first garment crotch portion 24, both front and rear, upwardly toward both sides of the garment 12 in the garment waist area. The first connecting section 30 as well as the first crotch portion 24 terminates to the left of the garment at a left edge 32.

The left garment piece 18, according to the invention, includes a left leg opening indicated generally at 42 and a second garment crotch piece or portion 44. Similarly to the right garment piece 16, the left garment piece 18 also includes a second garment crotch portion retaining means comprising a second connecting section 48 extending from the second garment crotch portion 44 upwardly both front and rear toward both sides of the garment in the garment waist area. The second connecting section 48 and second crotch portion 44 terminate to the right side of the garment 12 at a right edge 50.

In the preferred form of the invention, the right and left garment pieces 16 and 18, respectively, are formed in one piece to provide the respective leg opening, the garment crotch portion, and the connecting section. In one preferred form of the invention, the two garment pieces are each cut from a suitable fabric or other material in one piece in the required pattern and joined at a side seam such as the seam 52 in the left garment piece shown in FIG. 3. Also, in embodiments that include leg portions 14, the leg portions may also be cut along with the garment piece in one piece and connected together at an inseam 54 and outseam at the opposite side of the garment leg. Alternatively, where the garment is pantyhose, for example, each entire garment piece may be formed in the desired shape in a suitable weaving process.

FIGS. 1 and 2 show the right and left garment pieces 16 and 18 connected together according to the invention to form the garment crotch structure 10. The two garment pieces 16 and 18 are connected together generally only at the waist area of the garment preferably about the waistline 58 such that the first garment crotch portion 24 formed in the right garment piece 16 overlaps the second garment crotch portion 44 formed on the left garment piece 18. Although the garment may include right and left reinforcing means comprising reinforcing connections 60 at the right and left sides of the garment, both in the front and the rear, such reinforcing sections are only in the waist area of the garment.

Referring still to FIGS. 1 and 2, the left edge 32 of the right garment piece 16 and right edge 50 of the left garment piece 18 are generally not secured to the opposite garment piece. Rather, the left and right edges 32 and 50, respectively, and thus the crotch portions 24 and 44 are free to be parted manually by the wearer as indicated at arrows "P" in FIG. 2, to form a crotch opening for enabling the wearer to perform bodily functions without removing the garment. Further, once the left and right edges 32 and 50 are manually parted from the rear to form the crotch opening and the wearer is seated, contact between the garment pieces and the seat prevents the opened crotch structure from closing. The wearer thus need not hold the garment continuously to maintain the crotch portion open.

Although the crotch portions 24 and 44 may be parted manually as indicated in FIG. 2, the particular structure and connection of the garment pieces enables the crotch portions to remain in the closed position even during strenuous exercise. Specifically, the connection of the first crotch portion 24 between the right leg opening 22 and the waist area of the garment, particularly at the left side, maintains the crotch portion in the desired position. Similarly, the connection of the second crotch portion 44 between the left leg opening 42 and the waist area at the right side of the garment holds the second crotch portion in position overlapped with the first crotch portion.

Figure 4:
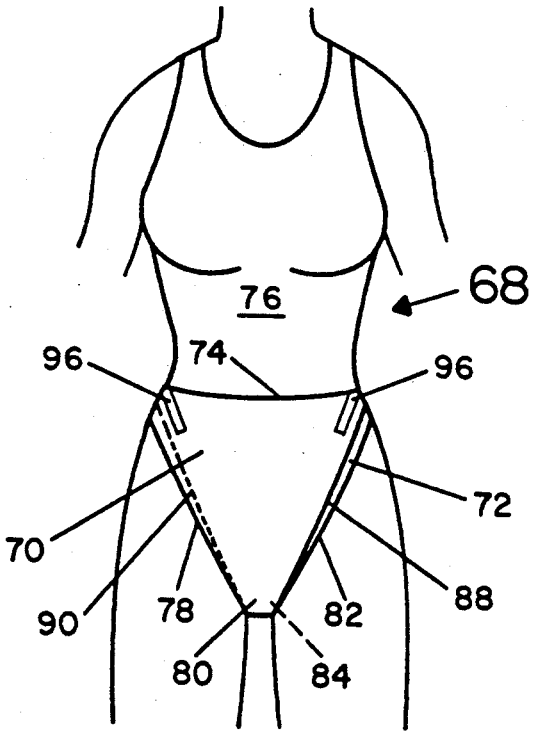
FIG. 4 is a view in perspective of an alternate form of the invention incorporated into a one-piece swimsuit or exercise leotard.

An alternate form of the invention is shown in FIG. 4 as incorporated into a one-piece swimsuit or leotard 68. This embodiment includes a right garment piece 70 and a left garment piece 72, each extending upwardly to a waist area shown generally at 74, similar to the embodiment shown in FIGS. 1–3. However, unlike the embodiment shown in FIGS. 1–3, the garment pieces 70 and 72 are connected to an upper garment portion 76. Also, the one-piece swimsuit or leotard embodiment shown in FIG. 4 includes a right leg opening 78 and first crotch portion 80 formed in the right garment piece 70, and a left leg opening 82 and a second crotch portion 84 formed in the left garment piece 72. The leg openings 78 and 82 are, however, cut higher and generally coincide with free edge 88 and 90, respectively, of the opposite garment piece.

According to the invention and similar to the embodiment shown in FIGS. 1–3, the crotch portions 80 and 84 of the right and left garment pieces 70 and 72 are retained in proper position in the crotch area by the connection between the respective leg opening and a connection 74 between the right and left garment pieces in the waist area of the garment. The connection between the garment pieces 70 and 72 is at least at opposite sides of the garment and preferably along the entire waistline 74 in both the front and rear of the garment. As in the embodiment in FIGS. 1–3, the connection may be reinforced with reinforcing stitching 96 at each side of the garment in the waist area.

According to the method of the invention, and referring again to FIGS. 1–3, the first garment crotch portion 24 is connected between the right leg opening 22 and the left side of the garment in the waist area. This step retains the first garment crotch portion 24 in the crotch area of the garment as though it were the only crotch portion. The method also includes connecting the second crotch portion 44 between the left leg opening 42 and the right side of the garment in the waist area. This connection overlaps the two garment crotch portions 24 and 44 in the crotch of the garment. However, the garment crotch portions 24 and 44 remain free to be parted manually in the crotch area to form a crotch opening due to the connection only in the waist area and the free edges 32 and 50. The crotch opening formed by parting the two crotch portions 24 and 44 may be used for performing bodily functions without having to remove the garment.

The act of parting the garment crotch portions 24 and 44 may place added stress on the opposite garment side waist connections. Thus, the connecting steps may preferably include applying reinforcing stitching 60 (FIGS. 1 and 2) or the like at the opposite side waist connections. Furthermore, the first and second crotch portions 24 and 44 also preferably include connecting sections 30 and 48 that extend upwardly front and rear from the particular crotch portion toward both sides of the garment in the waist area thereof. The method of the invention includes connecting these connecting sections together preferably along substantially the entire waistline of the garment.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. A garment crotch structure comprising:

A. a right garment piece having a right leg opening, a first crotch portion adjacent to the right leg opening, and a first connecting section extending upwardly front and rear from the first crotch portion to both sides of the garment in the garment waist area, the first connecting section having a left edge that extends from the first crotch portion upwardly both front and rear to the left side waist area of the garment;

B. a left garment piece having a left leg opening, a second crotch portion adjacent to the left leg opening, and a second connecting section extending upwardly front and rear from the second crotch portion to both sides of the garment in the garment waist area, the second connecting section having a right edge that extends from the second crotch portion upwardly both front and rear to the right side waist area of the garment; and C. the right garment piece and the left garment piece being connected together only in the waist area of the garment with the first and second crotch portions being overlapped across substantially the entire crotch area of the garment, and with the left edge of the right garment piece and the right edge of the left garment piece both being free along substantially their entire length and being connected to the opposite garment piece only in the garment waist area at the left side and right side of the garment, respectively, so that the first and second crotch portions may be parted manually by the wearer to form a crotch opening.

2. The garment crotch structure of claim 1 wherein the right garment piece and the left garment piece are connected together by suitable means along substantially the entire waistline of the garment.

3. The garment crotch structure of claim 1 including:

A. right edge reinforcing means for reinforcing the connection between the right edge of the left garment piece front and rear, and the right garment piece in generally the waist area of the garment; and B. left edge reinforcing means for reinforcing the connection between the left edge of the right garment piece both front and rear, and the left garment piece in generally the waist area of the garment.

4. The garment crotch structure of claim 3 wherein the garment crotch structure is incorporated into a pair of women's panties or the like which terminate at the right and left leg openings and at a waistband along which the right and left garment pieces are connected together.

5. The garment crotch structure of claim 3 wherein the garment crotch structure is incorporated into a pair of pantyhose or the like terminating upwardly at a waistband along which the right and left garment pieces are connected together and having garment legs extending from both the right and left leg openings.

6. The garment crotch structure of claim 3 wherein the garment crotch structure is incorporated into a leotard or the like in which the garment terminates downwardly at the right and left leg openings but continues upwardly in an upper garment portion extending above the waist area where the right and left garment pieces are connected.

7. A method of retaining an openable garment crotch closed in normal use where the garment crotch is comprised of first and second overlapping crotch portions, said method comprising the steps of:

A. connecting the first garment crotch portion between a right leg opeining and the left side of the garment in the waist area thereof so as to form a first free edge of material extending from the first crotch portion front and rear substantially to the waist area at the left side of the garment; and B. connecting the second garment crotch portion between a left leg opening and the right side of the garment in the waist area thereof so as to form a second free edge of material extending from the second crotch portion front and rear substantially to the waist area at the right side of the garment, whereby the first and second free edges may be parted manually to separate the first and second crotch portions to form a crotch opening.

8. The method of claim 7 wherein the first and second garment crotch portions each have a connecting section extending upwardly both front and rear to the waist area of the garment at both sides thereof and the step of connecting the first and second garment crotch portions includes connecting the two connecting sections at the waist of the garment.

9. The method of claim 7 wherein:

A. the step of connecting the first garment crotch portion includes reinforcing the end of the first free edge in the waist area; and B. the step of connecting the second garment crotch portion includes reinforcing the end of the second free edge in the waist area.

* * * * *